US006269526B1

(12) United States Patent
Bischoff et al.

(10) Patent No.: US 6,269,526 B1
(45) **Date of Patent: *Aug. 7, 2001**

(54) MODULAR BURIAL VAULT

(75) Inventors: William J. Bischoff, Birmingham, AL (US); Bill W. Wilcock, Houston, TX (US)

(73) Assignee: The York Group, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/969,907

(22) Filed: Nov. 13, 1997

(51) Int. Cl.[7] ..... A61G 17/00; E04H 13/00
(52) U.S. Cl. ..... 27/35; 52/128
(58) Field of Search ..... 27/35, 2, 4, 6, 27/10, 33, 3, 5, 7, 14, 16, 27; 52/128, 138, 142; D99/1, 6, 8, 12, 13; 220/4.24, 653, 651

(56) References Cited

U.S. PATENT DOCUMENTS

| | | | | |
|---|---|---|---|---|
| 1,375,758 | * | 4/1921 | Kennedy | 27/6 |
| 1,705,410 | * | 3/1929 | Laidlaw | 27/35 |
| 3,007,224 | | 11/1961 | Wean . | |
| 3,633,643 | | 1/1972 | Stilwell . | |
| 3,782,619 | * | 1/1974 | Dittbenner | 27/35 X |
| 3,969,798 | * | 7/1976 | Sahlin | 27/4 |
| 4,063,337 | | 12/1977 | Havey, III | 27/2 |
| 4,170,054 | * | 10/1979 | Ruffner et al. | 27/4 |
| 4,249,289 | | 2/1981 | Work | 27/35 |
| 4,253,220 | * | 3/1981 | Work | 27/7 X |
| 4,314,390 | | 2/1982 | Darby et al. | 27/35 |
| 4,320,562 | * | 3/1982 | Kelley | 27/2 |
| 4,372,018 | | 2/1983 | Miller, IV et al. . | |
| 4,523,358 | * | 6/1985 | Semon | 220/4.24 X |
| 4,788,757 | * | 12/1988 | Bethune et al. | 27/2 |
| 4,925,045 | * | 5/1990 | Logsdon | 220/4 |
| 5,010,697 | * | 4/1991 | Schwarten | 27/35 X |
| 5,042,674 | * | 8/1991 | Ramsay et al. | 220/4.24 |
| 5,121,529 | | 6/1992 | McClure | 27/7 |
| 5,261,199 | | 11/1993 | Schmidt . | |
| 5,425,163 | * | 6/1995 | Von Braun et al. | 27/35 X |
| 5,448,810 | | 9/1995 | Mackirdy . | |
| 5,471,718 | * | 12/1995 | Harrill | 27/7 |
| 5,485,661 | * | 1/1996 | McClure | 27/35 X |
| 5,611,125 | * | 3/1997 | Williams et al. | 27/3 |
| 5,771,550 | * | 6/1998 | Laphan et al. | 27/19 |

* cited by examiner

*Primary Examiner*—Brian K. Green
(74) *Attorney, Agent, or Firm*—Stevens, Davis, Miller & Mosher, L.L.P.

(57) ABSTRACT

An inexpensive burial vault is composed of two substantially identical modular enclosure segments which, when joined together, from an enclosed space in which a decedent confinement chamber may be placed. Each modular enclosure segment is composed of a bottom panel, anterior and posterior head panels, and a left and night side panel. The head panels and side panels are connected to the bottom panel with a slight flare outward, or inscribed angle between the bottom panel and the connected panels a little more than perpendicular.

18 Claims, 6 Drawing Sheets

MODULAR BURIAL VAULT

SPECIFICATION

1. Field of the Invention

The present invention relates to burial vaults, and more particularly to a modular burial vault.

2. Background of the Invention

Burial vaults are structures placed into a gravesite to protect a decedent confinement chamber, such as a casket, coffin or urn, from natural destructive elements such as water or the overlying weight of the earth. The vault prevents a decedent confinement chamber from collapsing when, after natural decay, the decedent confinement chamber has weakened and would otherwise be crushed by the earth overlaying it.

Prefabricated burial vaults are typically heavy duty metal structures comprising a flat base with a substantial metal dome. The dome is usually narrower than the base, resulting in a slight angle, or flare, in the side walls of the dome relative to the perpendicular from the base plate. This results in unused space within the burial vault when the decedent confinement chamber is placed inside. Further, the weight distribution between the base and the dome is substantial. A dome typically weighs 300 lbs., thus making it unmanageable to handle without some lifting device being employed.

A further drawback to the present burial vaults is in fabrication and shipping. The base—dome configuration necessitates at least two separate assemblies—one for the base and one for the dome. Further, the present burial vaults are shipped in an assembled fashion. This means that the dome and base are put together and shipped as a unit. The space enclosed by the vault is dead space in the shipping process.

In an alternative form, U.S. Pat. No. 5,121,529, discloses a burial shell formed by a chamber and a seal. The chamber is formed as two symmetrical half shells. While alleviating some of the transportation problem, this does not alleviate the problem of having two separate assemblies for the top and the half shells.

U.S. Pat. No. 4,249,289 discloses a combination burial vault and casket. This design employs the same traditional base and dome configuration discussed above. Therefore, this design has the same drawbacks.

U.S. Pat. No. 4,314,390 discloses a composite burial vault. The design comprises a base liner which is placed into a grave. The liner is filled with concrete. A top cover is then placed over the vault. While the empty liner can be transported, the segments are not modular and are not easily transportable.

BRIEF DESCRIPTION OF THE DRAWINGS

FIG. 10 is a front view of a rib support showing a support passageway and support strap running through.

SUMMARY OF THE INVENTION

Figure 1:
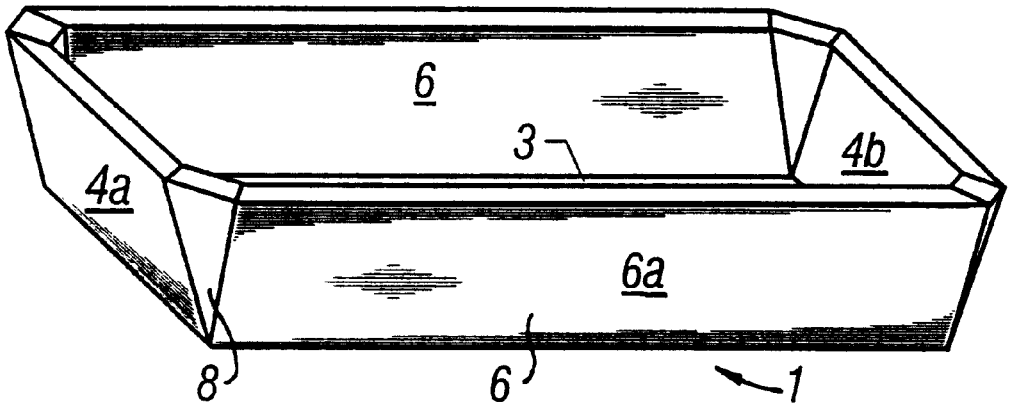
FIG. 1 is an angled view of a modular enclosure segment in accordance with the invention.

An object of the invention is to provide a modular burial vault where no excess assembly would be utilized in its production. Another object of the invention is to provide a burial vault that minimizes transportation space and thus costs associated with transportation of the vaults. A further object of the invention is to provide a design for a burial vault that cuts down on the thickness of the left and right side walls, and thus reduces manufacturing costs. A further object of the invention is to provide for a burial vault which weighs less than the burial vaults of the prior art. This allows a minimum of personnel to be used during the handling of the parts, and during the final assembly. A further object of the invention is to minimize the need for external lifting devices during all phases of modular construction, transportation, handling, and final burial vault placement. A further object of the invention is to minimize the excess volume in a burial vault, allowing for closer spacing of plots within a given burial area.

The present invention therefore provides an inexpensive and efficient burial vault. The invention comprises two modular enclosure segments, or box-like structures, which, when joined together, from an enclosed space in which a decedent confinement chamber may be placed In a preferred embodiment, the invention is directed to a box-like structure constructed from light weight steel. The box like structure has a bottom panel, anterior and posterior head panels, and a left and right side panel. The head panels and side panels are connected to the bottom panel with a slight flare outward, or inscribed angle between the bottom panel and the connected panels a little more than perpendicular.

In the preferred embodiment, the slight flare produces a gap between the head panels and the neighboring side panels. This gap is filled with an appropriately sized and shaped side extension connector panel, thus producing an open and continuous box like structure anchored by the bottom panel.

The side panels, head panels, and connector panels that fill the space between them form a perimeter to which a flanged lip is connected, the flanged lip being generally parallel to the bottom panel. In a preferred embodiment, the flanged lip is adapted with at least one socket-like indentation and one protrusion. Thus, when one modular enclosure segment is rotated so that the interiors, or concave faces of the box structures, are facing one another, an indentation will line up with a protrusion segment so as to inhibit further movement. This will also indicate proper lineup of the flanged lips. The lining up of the lips properly will significantly increase the strength of the overall structure.

In the preferred embodiment, rib supports are added to the bottom panel on both the interior, or concave face of the box structure, and the exterior, or convex face of box structure. These supports are adapted to receive a hook or strap, so that the modular box can be lifted using some external lifting device.

The entire structure can be made of a metal, preferably a lightweight metal, a plastic material, including thermoplastics and injection molded plastics, foam, as well as fiberglass.

DETAILED DESCRIPTION OF THE INVENTION

Figure 2:
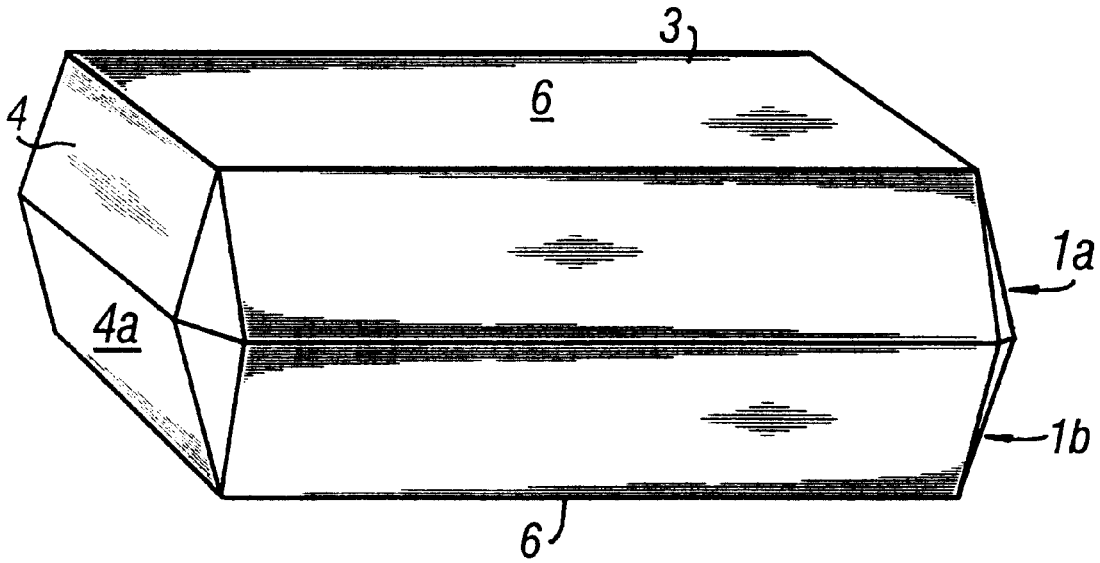
FIG. 2 demonstrates a modular enclosure segment with another modular enclosure segment rotated in place on top to form a burial vault.

FIG. 1 demonstrates a modular enclosure segment 1 for use in the invention. The modular enclosure segments are placed together as shown in FIG. 2, concave faces facing each other, to form burial vault 2 to which may be placed a decedent confinement chamber, such as a coffin or casket. Each enclosure segment 1*a* is substantially identical to any other enclosure segment 1*b*. In the most preferred embodiment, each enclosure segment 1*a* is identical to any other enclosure segment 1*b*. By having enclosure segment of the burial vault identical to the opposite piece, a manufacturer need only produce the one modular segment, thus saving greatly in manufacturing costs.

Figure 3:
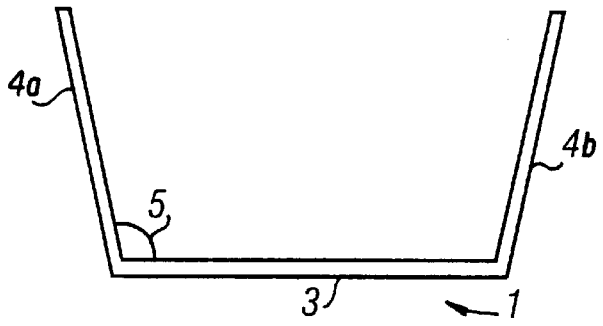
FIG. 3 is a cut-away view of the bottom panel and anterior head panel as well as bottom panel and posterior head panel forming an angle.
Figure 4:
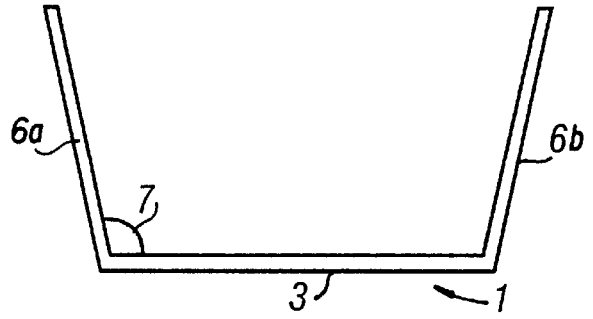
FIG. 4 is a cut-away view of the bottom panel with attached left and right side panels with defined angle.

Turning in greater detail to the modular enclosure segments, each modular enclosure segment is comprised of a bottom panel 3. Anterior head panel 4*a* and posterior head panel 4*b* are connected to bottom panel 3, and the inscribed angle 5 between bottom panel 3 and each of the head panels 4 is slightly greater than ninety degrees, producing a slight flare to modular enclosure segment 1, as shown in FIG. 3. Two side panels 6—left side panel 6*a* and right side panel 6*b*—are connected to bottom panel 3 in a similar fashion to form inscribed angle 7 in FIG. 4. If side panels 6 and head panels 4 are connected to bottom panel 3 in a slightly flared fashion, a roughly triangular area between head panels 4 and side panels 6 is left empty.

In a preferred embodiment, the side panels would be ridged, or rippled. This "ridging" or "rippling" of the longer side panels would create inherent beams in the side panels, thus minimizing any bowing of the modular enclosure segment. In another embodiment emphasizing support, the side panels would have support ribs. These support ribs could either be attached or could be a part of the mold for the enclosure.

Figure 5:
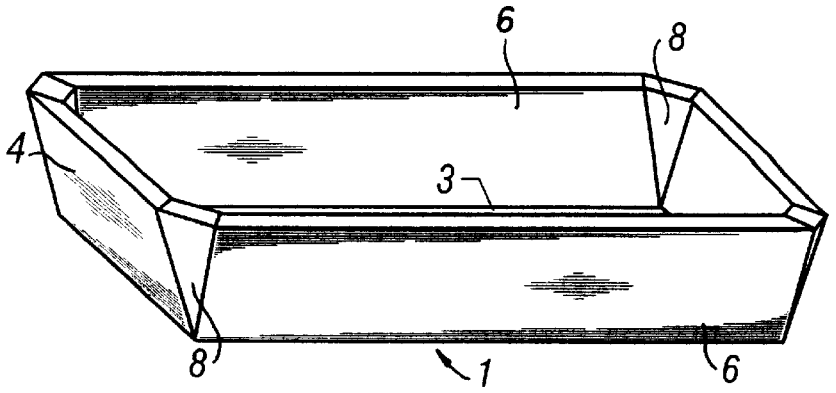
FIG. 5 is an angled view of a modular enclosure segment without flanged lips detailing the connector panels between the left and right side panels and anterior and posterior head panels.

In a preferred embodiment,as set forth in FIG. 5, a side extension panel 8 is connected to each head panel 4—side panel 6 intersection, thus filling the naturally occurring empty area produced by the slight flaring of side panels 6 and head panels 4. The addition of side extension panel 8 to complete the full wall is preferable because of the added strength and stability of the final vault.

Figure 6:
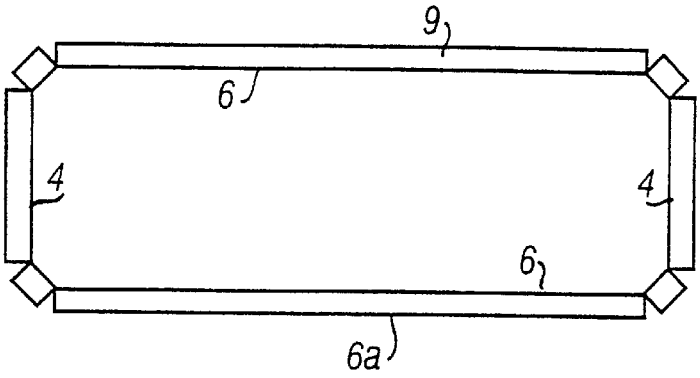
FIG. 6 is a top view of a modular enclosure segment with flanged lips running along anterior and posterior head panels, left and right side panels, and connector panels.

A flanged lip 9 is attached to the perimeter defined by side panels 6 and head panels 4 and is generally parallel to the bottom panel 3. If side extension panels 8 are present, the flanged lip would also be attached to them, thus forming a lip perimeter completely around modular enclosure segment 1, as shown in FIG. 6.

In the preferred embodiment, the modular enclosure segment 1 would be made of 14 gauge steel. Other burial vaults require the use of heavier duty steel, but due to the design characteristics of the present invention, a lighter material can be employed. The lighter duty material is cheaper to use in the production process, easier to form, and lighter to ship. These all contribute to the overall cost effectiveness and efficiency of the invention. Other grades of steel could be used. Plastics, especially the use of injection molding and thermoplastics could also be utilized in the invention. Injected foams or fiberglass could also be employed in the manufacture of the invention.

Figure 7:
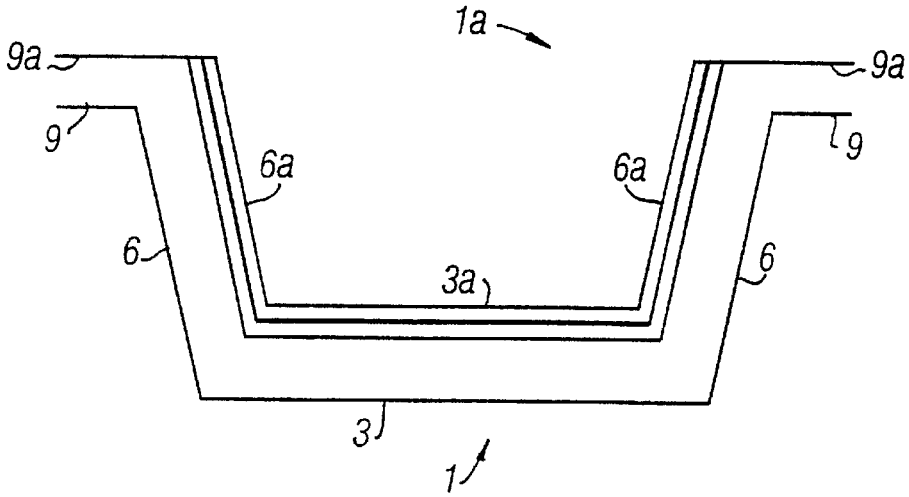
FIG. 7 is a cut-away view of nested modular enclosure segments.

The design of the modular enclosure segment 1 also contributes greatly to shipping costs. The slightly flared design of the head panels 4 and side panels 6 allows multiple modular enclosure segment 1 to be completely nested within one another. Thus, the units could be shipped as stacks of modular enclosure segments with little wasted space. When nested, as shown in FIG. 7, it should be noted that multiple modular enclosure segment 1 and 1*a* take just over the volume of modular enclosure segment 1. Thus great efficiencies in shipping are achieved by using nested stacks of the present invention.

Figure 8:
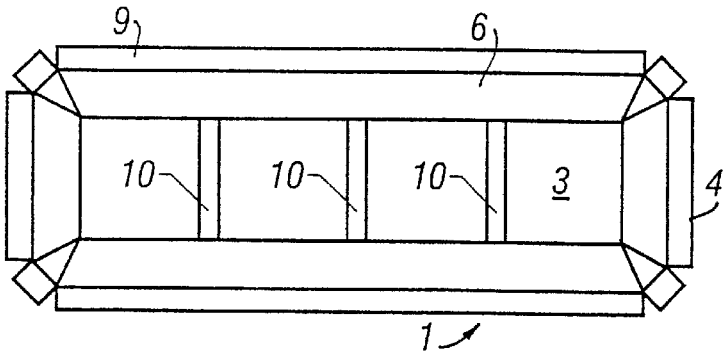
FIG. 8 is a bottom view of a modular enclosure segment showing rib supports placed on the bottom surface of bottom panel.

In a preferred embodiment, as shown in FIG. 8, support ribs 10 are attached width-wise, or parallel to head panel 6, to bottom panel 3. It should be noted that the support ribs 10 can be placed lengthwise on bottom panel 3 as well. Support ribs 10 can be attached either on the face of bottom panel 3 forming the convex face, or the exterior face, of modular enclosure segment 1, or on the face of bottom panel 3 forming the concave face, or the interior face, of modular enclosure segment 1. In the preferred embodiment in which the ribs are placed solely on one face of the bottom panel, the ribs are placed on the interior face of bottom panel 3.

For ease of manufacturing, shipping, and use, ribs are placed on both faces. This ensures that any modular enclosure segment is identical to any other one. Support ribs 10 give added support to counter weight placed on the exterior face of the modular enclosure segment 1. In addition, ribs placed on the interior face of bottom panel 3 ensure that a space is present between the modular enclosure segments when nested. When nested, the exterior face of bottom panel 3 of the topmost modular enclosure segment would rest upon the support ribs placed on the exterior face of bottom panel 3 on the bottom modular enclosure segment. This causes the topmost modular enclosure segment's flanged lips to rise a set amount over the other segment's flanged lips. This aids in handling and separation of the nested segments after delivery.

Figure 9:
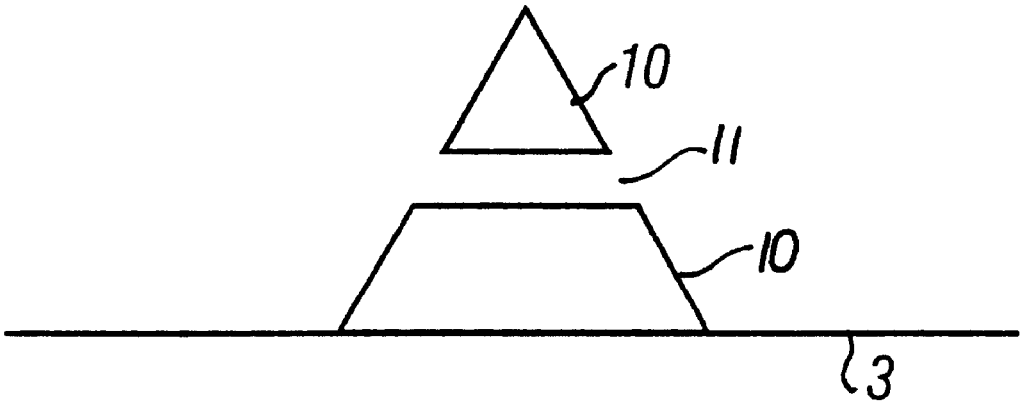
FIG. 9 is a detailed cut-away view of a rib support with a support passageway.
Figure 10:
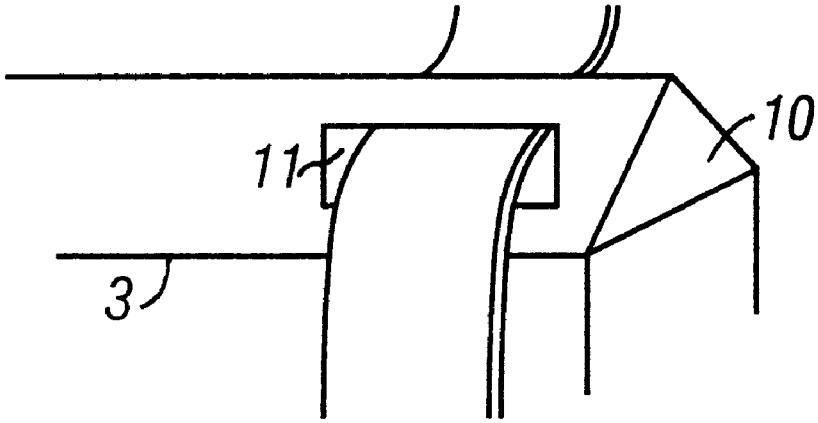

In a preferred embodiment, support ribs 10 are designed with at least one passage 11 through them. As shown in FIGS. 9 and 10, this allows the support rib 10 to be used with straps, hooks or other lifting devices for handling purposes. Preferably, at least two passages 11 would be present. Passages should be symmetrical with respect to support rib 10, so that if straps are placed through them, equal loads will be placed on each strap.

An additional advantage of the modular enclosure segment is now realized in their actual use. The ability to use lighter materials greatly aids in the handling characteristics of the burial vault. Heavier materials greatly increase the weight of the unit. Thus, it is easier for handling at grave side and shipping when using the lighter materials. Secondly, other conventional burial vaults can have a lopsided proportion of weight in one segment or another. Thus, a 90–10 ratio on an average 300 pound unit would mean that one segment would be 270 pounds. With this weight, some sort of mechanical lifting device would be required to move the heavier segment. In the current design, the modular enclosure segments comprising the burial vault are identical. With the lighter materials used, two men can easily lift, handle, and place the unit without the aid of an external lifting device.

To form the final burial vault 2, one modular enclosure segment 1 is lowered into the dug grave concave face facing upwards. This can be accomplished manually or by the use of straps run through opening 11 in support ribs 10. Another modular enclosure segment 1, concave face facing downwards, is then lowered onto the first modular enclosure segment. As before, the modular enclosure segment may be lowered manually or by using straps, hooks, or other lifting mechanism placed through opening 11 in support ribs 10. The top modular enclosure segment is then adjusted so that flanged lips 9 of both modular enclosure segment are engaged in a touching relationship about the perimeter of the modular enclosure segment's.

Figure 11:
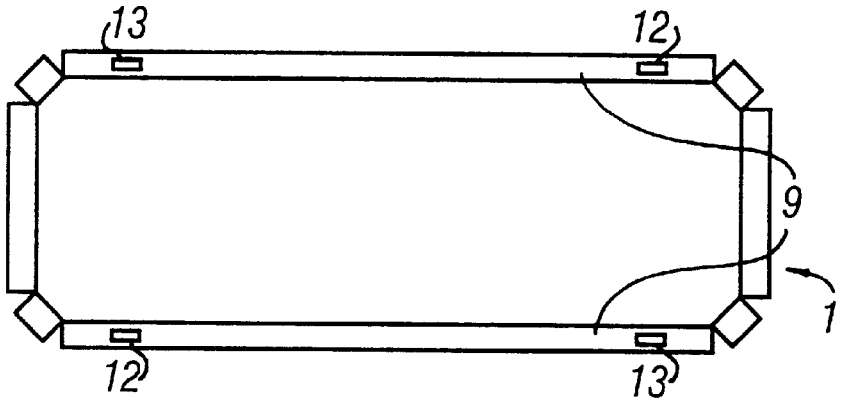
FIG. 11 is a top view of a modular enclosure segment with flanged lips showing the location of guiding mechanisms.
Figure 12:
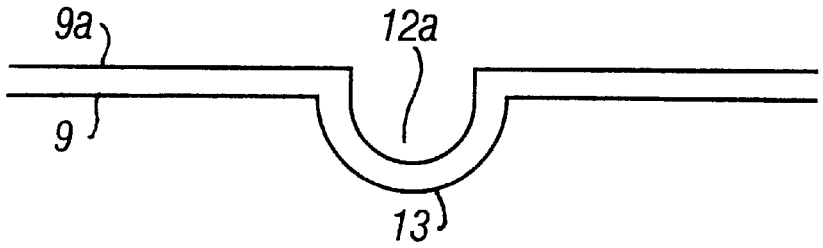
FIG. 12 is a cut-away side view of connected flanged lips showing the workings of a depression and protrusion acting as guiding mechanisms.

In a preferred embodiment, flanged lips 9 have guiding devices 12 and 13 to line up the flanged lips properly. In one embodiment, this guiding device comprises alternating depressions and protrusions, as shown in FIG. 11. Thus, when the accompanying modular enclosure segment is rotated and placed concave face down on the concave face up modular enclosure segment, there will be a matching protrusion 13—depression 12 pair facing one another. This is shown in two alternatives presented in FIGS. 12 and 13. In FIG. 12, flanged lips 9 and 9*a* have been turned so protrusion 12*a* matches corresponding depression 13. This serves to match up the modular enclosure segment.

Figure 13:
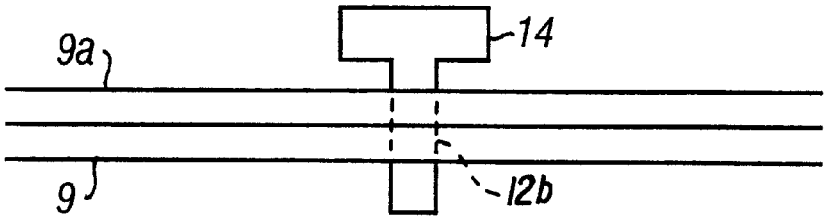
FIG. 13 is a cut-away side view of connected flanged lips showing a guidance device as a hole in one flanged lip with a bolt.

In FIG. 13, the invention uses a guide hole 12*b* and corresponding bolt 14 to match up flanged lips 9 and 9*a*, and stabilizing the overall burial vault.

The use of flanged lips allows greater stability for the unit, and provides extra support in the segment. This extra support of the design allows for the use of lighter materials in the construction of the invention.

Figure 14:
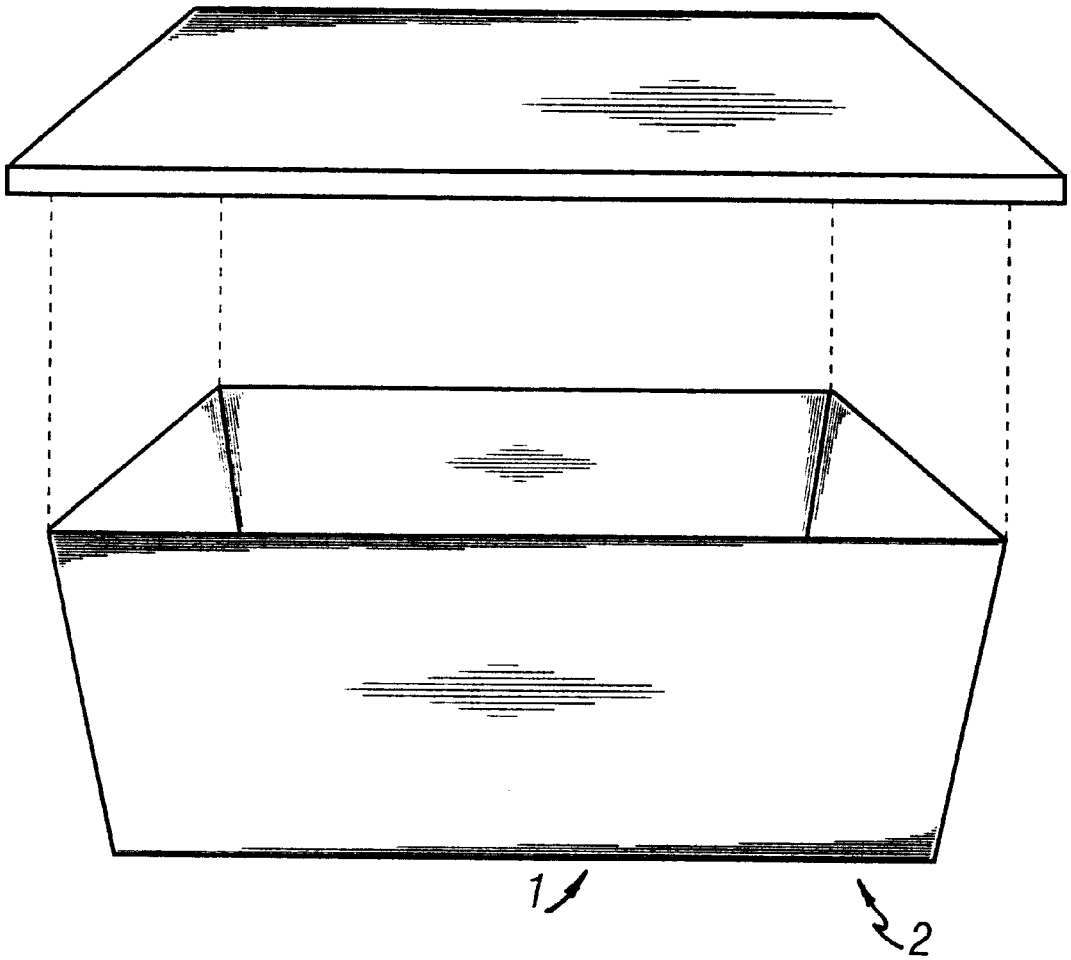
FIG. 14 (PRIOR ART)
FIG. 14 is a cut-away front view of a normal burial vault.

Another added benefit of the overall design is realized in the symmetrical aspects of the burial vault construction. In a normal burial vault, flanged sides of the head cause the unit to have an overall profile as shown in FIG. 14. The symmetrical design of the present burial vault 2 with the same angle of flanged side is further represented in FIG. 14. Thus, for the same width casket or coffin, the symmetrical design of the present invention allows for a plot width less than that of a conventional burial vault, as shown in the superposition of FIG. 14. This leads to a greater economy in the size of plots in a particular area.

Various modifications may be made in the nature, composition, operation and arrangement of the various elements, steps and procedures described herein without departing from the spirit and scope of the invention as defined in the following claims.

What is claimed is:

1. A burial vault capable of supporting an earth load overlaying it, said vault comprising two identical units, the units being sized and shaped so as to nest one within the other, each unit defined by a bottom panel;

at least two side panels attached to said bottom panel;

an anterior and posterior head panel connected to said bottom panel and said side panels;

a perimeter of each unit defined by said side panels and anterior and posterior head panels, said perimeter having an uppermost surface;

a vault chamber having an interior for the placement therein of a decedent confinement chamber, said vault chamber formed by said side panels, anterior and posterior head panels and bottom panel of each of said two identical units when said two identical units are abutted together so that their perimeters are in a touching relationship with one another;

said identical units each including a flanged lip which extends at least partly along said uppermost surface of said perimeter and is generally parallel to said bottom panel, having one unit's flanged lip capable of abutting together and engaging in a touching relationship with another unit's flanged lip when two of said identical units are abutted together to form said vault chamber; and said identical units each including at least one rib support attached to said bottom panel to ensure that a space is present between said two units when nested, causing one said unit's flanged lip to rise a set amount over another said unit's flanged lip.

2. The burial vault of claim 1, wherein the angle between the bottom panel and each side panel of each unit is greater than 90°.

3. The burial vault of claim 2, wherein the angle between the bottom panel and the anterior head panel of each unit and the angle between the bottom panel and the posterior head panel of each unit is greater than 90°.

4. The burial vault of claim 1, wherein the side panels are three-sided.

5. The burial vault of claim 1, wherein the flanged lip extends along the entire perimeter of each of said units.

6. The burial vault of claim 1, wherein the flanged lip has guiding means for aligning the units to each other.

7. The burial vault of claim 6, wherein the guiding means comprises a depression in the flanged lip.

8. The burial vault of claim 6, wherein the guiding means comprises an opening in the flanged lip.

9. The burial vault of claim 6, wherein the guiding means comprises a protrusion in the flanged lip.

10. The burial vault of claim 1, wherein the bottom panel has an interior surface and the at least one rib support is attached to the interior surface of the bottom panel of each unit.

11. The burial vault of claim 10, wherein said at least one rib support further contains at least one passageway for insertion for handling or lifting mechanism.

12. The burial vault of claim 1, wherein each of the units is comprised of a material selected from the group consisting of metal, plastic, foam, and fiberglass.

13. The burial vault of claim 1, wherein the side panels have at least one ridged surface.

14. The burial vault of claim 1, wherein the side panels further comprise support ribs.

15. A load-bearing burial vault comprising two identical modular enclosure segments, said modular enclosure segments being sized and shaped to be nestable with identical modular enclosure segments, each modular enclosure segment comprising:

a bottom panel;

a right and left side panel connected to said bottom panel, the angle defined by said bottom panel and each of said right and left side panels being greater than 90°;

a posterior and an anterior head panel connected to said bottom panel and said right and left side panels, the angle defined by said bottom panel and said posterior and anterior head panels being greater than 90°;

a perimeter defined by said left and right side panels and said anterior and posterior head panels, said perimeter having an uppermost surface;

a vault chamber having an interior for placement therein of a decedent confinement chamber, said vault chamber formed by said left and right side panels, said posterior and anterior head panels and said bottom panel of each of two of said identical modular enclosure segments when said two identical modular enclosure segments are abutted together so that their perimeters are in a touching relationship with one another;

said identical segments each including a flanged lip generally parallel to said bottom panel and attached to said uppermost surface of said perimeter and extending at least partly along said uppermost surface, having one segment's flanged lip capable of abutting together and engaging in a touching relationship with another segment's flanged lip when two of said identical modular enclosure segments are abutted together to form said vault chamber; and said identical segments each including at least one rib support attached to said bottom panel to ensure a space is present between said two modular enclosure segments when nested, causing one segment's flanged lip to rise a set amount over another segment's flanged lip.

16. The burial vault of claim 15, wherein the side panels are three-sided.

17. The burial vault of claim 15, wherein the flanged lip extends along the entire perimeter of each of the enclosure segments.

18. The burial vault of claim 15, wherein the side walls have ridges.

* * * * *